US009406990B2

(12) United States Patent
Sweetman

(10) Patent No.: US 9,406,990 B2
(45) Date of Patent: Aug. 2, 2016

(54) ADJUSTABLE WAVEGUIDE ASSEMBLY

(71) Applicant: Keyssa, Inc., Campbell, CA (US)

(72) Inventor: Eric Sweetman, Portland, OR (US)

(73) Assignee: Keyssa, Inc., Campbell, CA (US)

( * ) Notice: Subject to any disclaimer, the term of this patent is extended or adjusted under 35 U.S.C. 154(b) by 8 days.

(21) Appl. No.: 14/601,212

(22) Filed: Jan. 20, 2015

(65) Prior Publication Data

US 2015/0207198 A1 Jul. 23, 2015

Related U.S. Application Data

(60) Provisional application No. 61/929,367, filed on Jan. 20, 2014.

(51) Int. Cl.
*H01P 3/04* (2006.01)
*H01P 3/12* (2006.01)
*H01P 5/04* (2006.01)

(52) U.S. Cl.
CPC ..... *H01P 3/12* (2013.01)

(58) Field of Classification Search
CPC ..... H01P 3/12; H01P 5/04
USPC ..... 333/113, 24 R, 248, 111
See application file for complete search history.

(56) References Cited

U.S. PATENT DOCUMENTS 2,496,837 A * 2/1950 Woodyard ..... G01R 1/26 324/95
2,898,559 A * 8/1959 Heinard ..... H01P 5/04 333/111
2,951,217 A * 8/1960 Clapp ..... H01P 1/068 333/113
3,419,826 A * 12/1968 MacWilliams, Jr. .... H01P 1/068 333/248
3,882,396 A * 5/1975 Schneider ..... H01P 5/04 333/248
4,692,721 A * 9/1987 Ito ..... H01P 1/068 333/109
5,057,797 A * 10/1991 Heddebaut ..... H04B 5/0018 333/24 R
5,838,218 A * 11/1998 Rupert ..... G02B 6/3504 333/106
6,433,741 B2 * 8/2002 Tanizaki ..... 333/161
6,737,934 B2 * 5/2004 Yamada ..... H01P 5/188 333/111

* cited by examiner

*Primary Examiner* — Dean Takaoka
(74) *Attorney, Agent, or Firm* — Fenwick & West LLP

(57) ABSTRACT

A waveguide assembly system includes a fixed port, a sliding port, and a transmission path from the fixed port to the sliding port. The transmission path includes a waveguide assembly that includes a first minor face corresponding to the fixed port, a first major face that includes a recess extending from the first minor surface towards the fixed port. The waveguide assembly system also includes a port assembly with a first major surface disposed opposite to the first major surface of the waveguide assembly. The port assembly includes at least one port having a first opening on the first major surface of the port assembly and a second opening on a second major surface of the port assembly. The port assembly includes one or more stubs positioned to impede electromagnetic energy propagation beyond a specified distance within the port tab assembly.

17 Claims, 5 Drawing Sheets

ADJUSTABLE WAVEGUIDE ASSEMBLY

CROSS REFERENCE TO RELATED APPLICATIONS

This application claims the benefit of U.S. Provisional Patent Application No. 61/929,367, filed on Jan. 20, 2014, which is incorporated by reference in its entirety.

BACKGROUND

1. Technical Field

This disclosure relates using a waveguide assembly to propagate electromagnetic energy operating in the extremely high frequency (EHF) band of the electromagnetic energy spectrum.

2. Description of the Related Arts

Advances in electronic communication device technology have produced smaller devices with increased storage capacity, and faster transfer rates. Similar gains, however, have not been realized in the connectivity technology to transfer data to and from these devices. Mechanical connectors occupy valuable device area, create signal integrity issues, wear out over time, and create alignment challenges. These limitations often result in a larger device size, increased device cost, and limited transfer data rate between devices or between components within a device.

BRIEF DESCRIPTION OF THE DRAWINGS

The teachings of the embodiments of the present disclosure can be readily understood by considering the following detailed description in conjunction with the accompanying drawings.

DETAILED DESCRIPTION OF EMBODIMENTS

The Figures (FIG.) and the following description relate to preferred embodiments of the present disclosure by way of illustration only. It should be noted that from the following discussion, alternative embodiments of the structures and methods disclosed herein will be readily recognized as viable alternatives that may be employed without departing from the principles of the present disclosure.

Reference will now be made in detail to several embodiments of the present disclosure, examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the embodiments described herein.

Figure 1A:
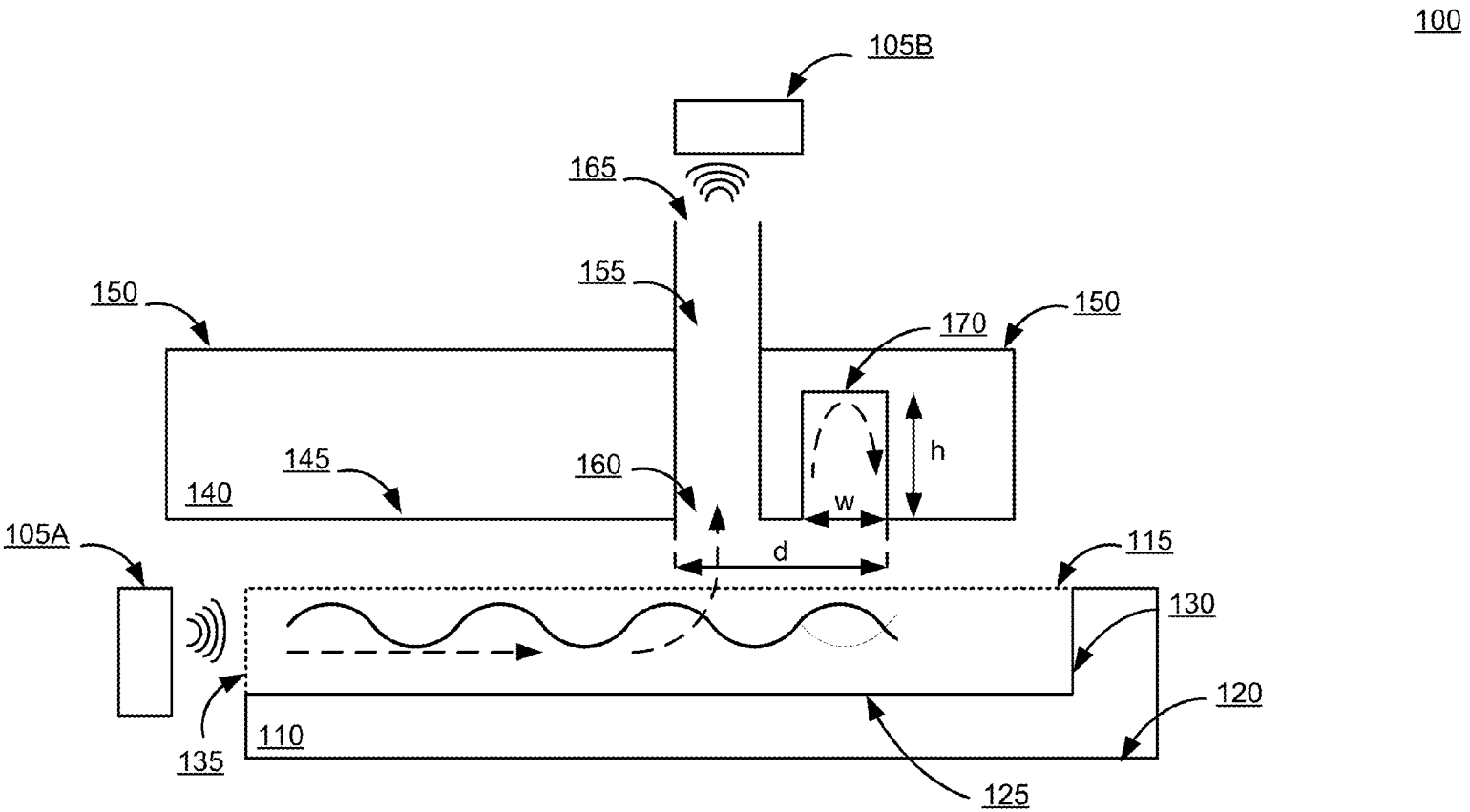
FIG. 1A is a side view of one implementation of a waveguide assembly system for establishing a communication channel between a pair of EHF communication units, according to one embodiment.

FIG. 1A is a side view of one implementation of a waveguide assembly system 100 for establishing a communication channel between EHF communication units. The waveguide assembly system 100 includes the waveguide assembly 110 and sliding port tap assembly 140. Portions of the waveguide assembly 110 and the sliding port tap assembly 140 form a path for communicating data between extremely high frequency (EHF) communication unit pair 105A and 105B.

The EHF communication unit 105 includes circuitry configured to transmit and receive close proximity extremely high frequency electromagnetic energy (i.e., transmissions). Examples of a communication interface unit 105 are described in U.S. patent application Ser. No. 13/471,052, which is incorporated by reference in its entirety. The EHF communication unit 105 uses EHF close proximity coupling to exchange information at high data rates (e.g., 8 Gb/s) over a transmission path using EHF frequencies (typically, 30-300 GHz). The conduction path may include air or a dielectric material suitable to transmit electromagnetic energy in the EHF frequency range.

In one embodiment, the EHF communication unit 105 includes a transmitter circuit and a receiver circuit coupled to an interface controller. The EHF communication unit communication interface unit 105 also includes a transducer coupled to the output of the transmitter circuit and the input of the receiver circuit. The transmitter circuit is configured to receive electrical information and send the received electrical information to the transducer for conversion to an EHF signal for transmission. Further details of the description of the transmitter circuit, the receiver circuit, and the transducer are described in U.S. patent application Ser. No. 13/760,089, and U.S. patent application Ser. No. 14/135,458, both of which are incorporated by reference in their entirety.

Returning to FIG. 1A, the EHF communication unit 150A transmits EHF energy into the waveguide assembly 110 to the EHF communication unit 105B positioned at an opening of the sliding port tap assembly 140 via the path indicated by the arrows. The communication path also supports communication in the opposite direction, traveling from the opening of the sliding port tap assembly 140 to the opening the waveguide assembly facing the EHF communication unity 105A.

The waveguide assembly 110 comprises an electrically conductive body configured to direct the propagation of EHF energy in a specified manner. The conductive body is composed of a rigid or semi-rigid material sufficient to conduct electromagnetic energy in the EHF frequency range of the electromagnetic spectrum. In one implementation, the conductive body may be a plastic, such as the housing, case, or other portion of an electronic device. In another implementation, the conductive body is formed from a plurality of materials with various dielectric constants arranged in a specified manner. Based on the types of materials and the manner in which the materials are arranged relative to each other, the conductive body may alter one or more transmission characteristics of EHF energy conducted by the waveguide assembly.

As shown in FIG. 1A, the waveguide assembly 110 is substantially planar with a first major face 115 and a second major face 120 on an opposing side of the waveguide assembly 110 relative to the first major face 115. The electrically conductive body of the waveguide assembly 110 may be any shape. In one implementation, the electrically conductive body may define a regular shape, such as a parallelogram or a circle. In another implementation, the conductive body may define a curved major surface, so as to resemble a section of the surface of a sphere, a cylinder, a cone, a torus, helix, or the like, as later described with respect to FIG. 2.

In one implementation, as shown in FIG. 1A, the first major face 115 includes a recess or cavity. The recess is formed by the opening in a portion of the first major face 115 and a recess surface 125 that extends from a first end 130 of the recess to a second end of the recess that corresponds to the first minor face 135 of the waveguide assembly 110. The opening in the first major face 115 may refer to a physical opening in the first major face 125, such an aperture. The opening may also refer to a portion of the first major face 125 comprised of a material that permits EHF energy to pass through the opening substantially unchanged. In one embodiment, the recess surface 125 is substantially planar and has a substantially rectangular periphery. Generally, the recess surface 125 is selected so that the cross-section of the waveguide assembly 110 and the sliding port tap assembly 140 is the same or substantially similar along the transmission path. Such a configuration causes that distance between the recess surface 125 and the major surface 145 of the sliding port tap assembly 140 to maintain relatively constant along the corresponding portion of the transmission path.

In one embodiment, at least a portion of the region within waveguide assembly 110 formed by the recess is comprised of a dielectric material, such as air, a vacuum, or non-conductive materials such as plastics. The dielectric material causes the EHF energy transmitted by the EHF communication unit 105A to propagate from the first minor face 135 through the dielectric portion into the recess as shown in FIG. 1. Similarly, the dielectric material within the waveguide assembly 110 also causes the EHF energy transmitted by the EHF communication unit 105B to the waveguide assembly 110, via the sliding port tap assembly 140, to propagate in the opposite direction as indicated by the dashed arrows. The sides of the conductive body, other than the portion of the first major face extending over the recess, may be embedded in conductive materials, such as metallic plates to contain the EHF energy within the waveguide assembly 110. Example conductive materials include metals, conductive foam, conductive plastics, conductive liquids, or other suitable conductive materials.

The waveguide assembly 110 is mated with a sliding port tap assembly 140 to create a directed channel of variable length to propagate EHF energy between EHF communication units 105A and 105B. In one implementation, the sliding port tap assembly 140 also includes an electrically conductive body comprised of a same type of material as the waveguide assembly 110. The sliding port tap assembly 140 has a first major face 145 that opposes the first major face 115 of the waveguide assembly 110. The sliding port assembly 140 also includes a second major face 150 located opposite the first major face 145. Each of the first major face 145 and the second major face 150 includes an opening forming a slot or port 155 extending through the sliding port tap assembly 140. In one implementation, at least a portion of the port 155 may be filled with a dielectric material, such as air. The sliding port tap assembly 140 and waveguide assembly 110 may be positioned so that the first opening 160 of the port 155 on the first major face 145 of the sliding port tap assembly 140 is positioned to face the opening in the first major face 115 of the waveguide assembly 110. In one implementation, the second opening 165 of the port 155 extends beyond the second major face 150 of the sliding port tap assembly 140. In other implementations, the second opening 165 of the port 155 is substantially co-planar with the second major face 150 of the sliding port tap assembly. The first and second openings of the port 155 may be similar to the opening in the major surface 115 of the waveguide assembly 110.

In one implementation, the first major face 145 of the sliding port tap assembly 140 is placed in contact with the first major face 115 of the waveguide assembly 110. In another implementation, the first major face 145 of the sliding port tap assembly 140 is placed within specified distance from the first major face 115 of the waveguide assembly 110 such that there is a gap between the sliding port tap assembly 140 and the waveguide assembly 110. The gap may be filled with air or another material having a dielectric constant suitable to direct EHF energy between the first opening 160 of the sliding port tap assembly 140 and the opening in the major face 115 of the waveguide assembly 110. In one implementation, the specified distance between the first major face 115 of the waveguide assembly 110 and the first major face 145 of the sliding port assembly 140 does not exceed the cut-off dimension of the wavelength of the EHF energy conducted through the waveguide assembly 110 and the sliding port tap assembly 140 via the port 155.

The sliding port tap assembly 140 includes one or more transmission line stubs 170 to impede electromagnetic energy propagation beyond a specified distance within the waveguide assembly 110 relative to the position of the port 155. In one implementation, one or more stubs 170 are positioned within a specified distance from the port 155 that is opposite the direction EHF energy propagates towards the port 155. The stub 170 operates as a reactive element in the transmission line formed by the waveguide assembly 110 and the port 155. The extent to which the stub 170 impedes electromagnetic energy propagation beyond the specified distance depends on one or a combination of the position of the stub 170 relative to the port 155 and the stub 170 attributes. For example, the position of the stub 170 may be selected to be a distance d from the port 155 such that at the distance d the electromagnetic energy reflected from the stub 170 generates a waveform that is 180 degrees out of phase from the forward propagating waveform generated by EHF communication unit 105A. This creates a voltage minimum at distance d that cancels the reflected energy from the forward propagating waveform as shown in FIG. 1. By canceling the reflected energy, the stub 170 increases the amount of electromagnetic energy of the forward propagating waveform that is directed into the port 155 and thus received by the EHF communication unit 105B.

Example attributes of the stub 170 include dimensions (e.g., height, width, etc.) and material type of the stub 170. The material type of the stub 170 may be a dielectric material and/or suitable material to absorb electromagnetic energy operating in the radio frequency (RF) spectrum. Example materials include electromagnetically lossy material, resistive material, and dissipative materials. In some embodiments, one or more stubs 170 having one or a combination of different dimensions or comprised of different materials may be used to modify the transmission line characteristics. For example, although shown as having a rectangular shape, the stub 170 may have a hemispherical, domed shape, prism shaped or any other configuration and combination for impeding EHF energy propagation beyond a specified location. In another example, multiple stubs 170 are included in the sliding port tap assembly 140. In such an example, each stub 170 may have the same or different dimension or other attributes. In a further example, multiple stubs 170, one comprised of air and another comprised of an RF absorbing material may be included in the sliding port tap assembly 140.

Figure 1B:
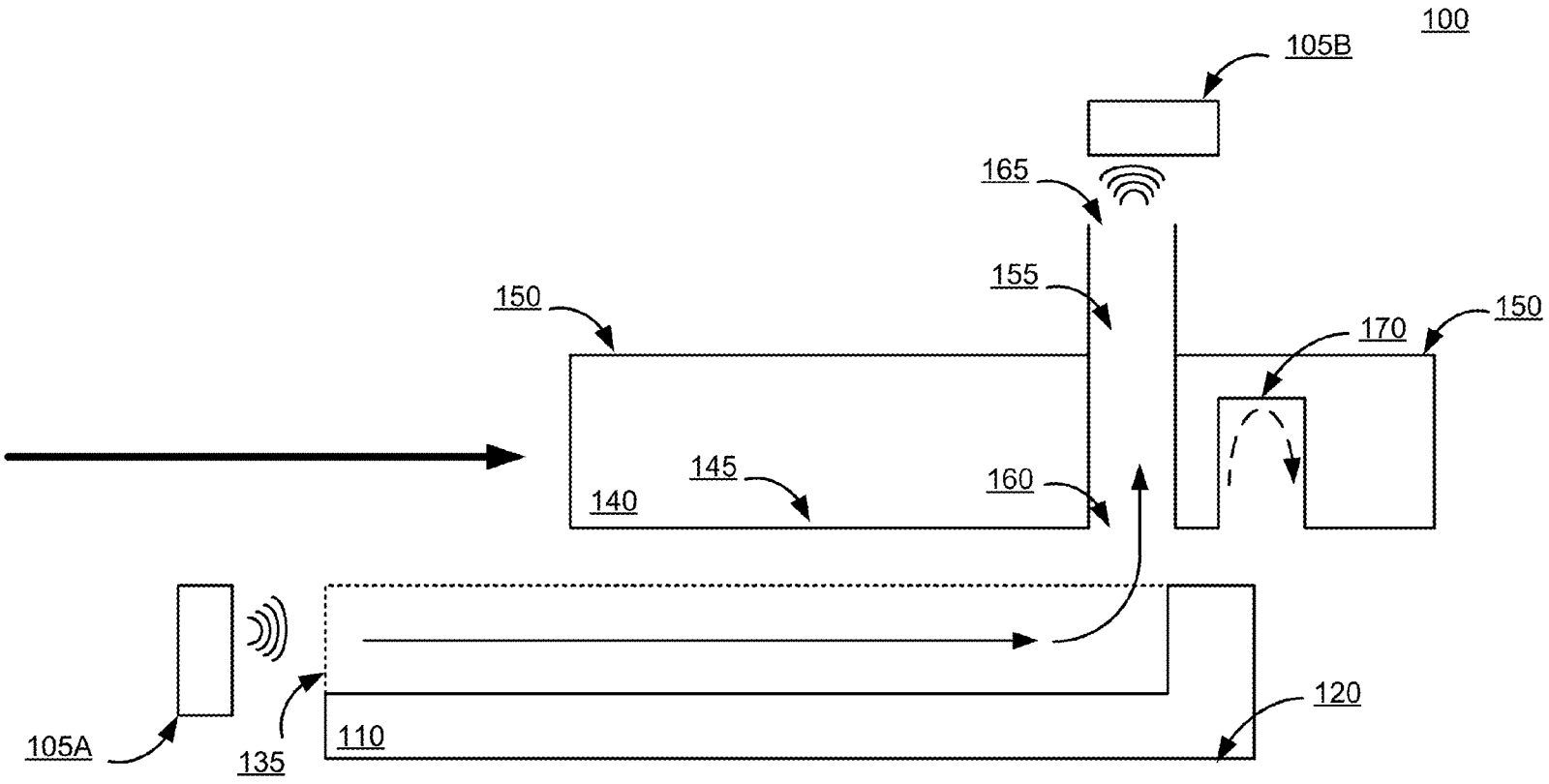
FIG. 1B is a side view the implementation of a waveguide assembly system in FIG. 1A in an alternative orientation, according to one embodiment.
Figure 1C:
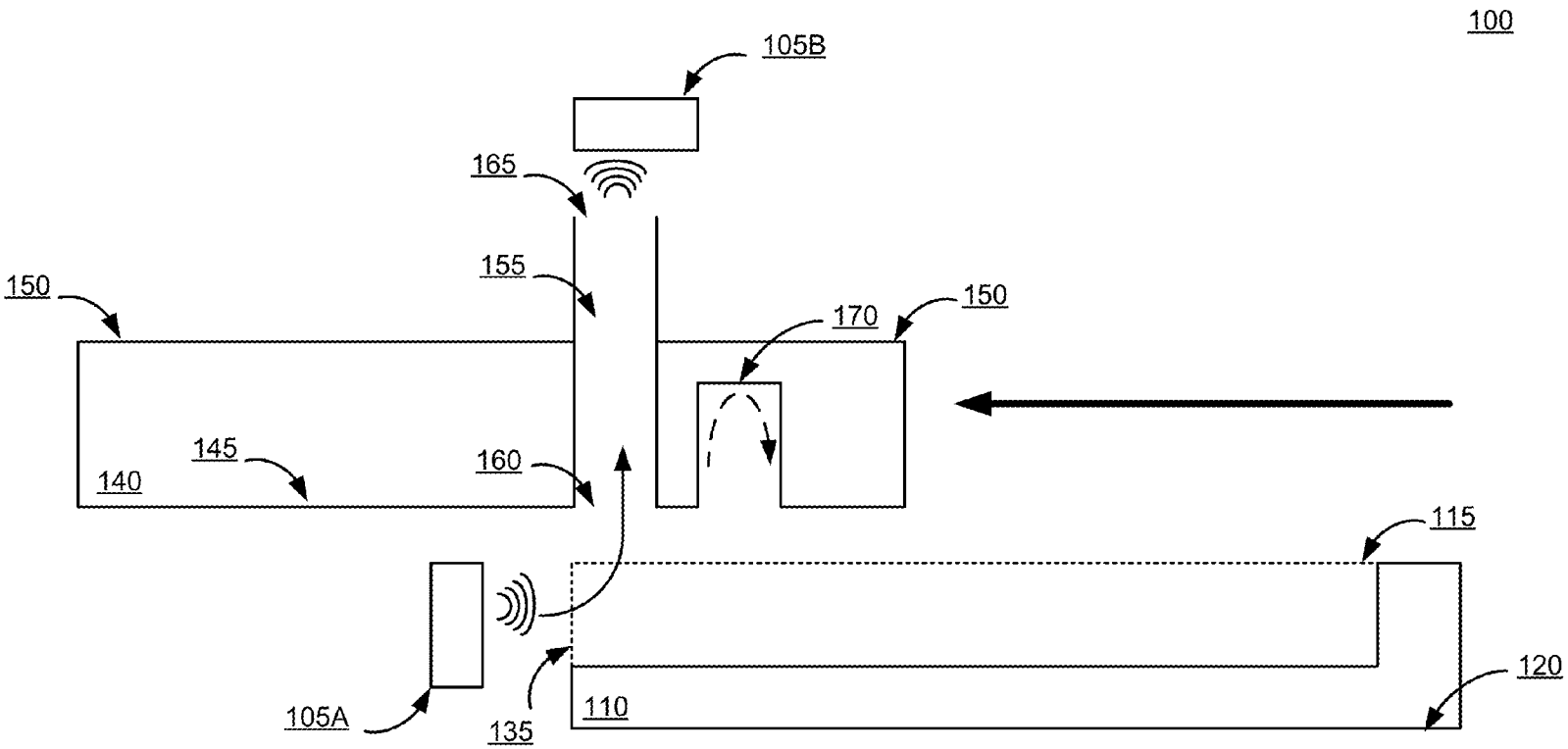
FIG. 1C is a side view the implementation of a waveguide assembly system in FIG. 1A in an alternative orientation, according to one embodiment.

In some implementations, a stub 170 is not used depending on the extent to which the opening 160 of the port 155 is aligned with opening of the first major face 115 of the waveguide assembly 110. The sliding port tap assembly 140 and the waveguide assembly 110 may be moved relative to each other, so that the distance between the communication units may be changed. In some embodiments, the waveguide assembly 110 may be in a fixed position relative to the position of the sliding port tap assembly 140. While in other embodiments, such as shown in FIGS. 1A and 1B, the waveguide assembly 110 may be moved relative to the sliding port tap assembly 140. For example, FIG. 1B shows the sliding port tap assembly 140 moved to the full right position. In this case, the forward propagating EHF waveform does not pass through the close end 130 of the cavity. Accordingly, the forward propagating waveform does not reach the stub 170. In contrast, when the sliding port tap assembly 140 is moved to the full left position, as shown in FIG. 1C, the forward propagating EHF waveform does reach the stub 170 before reaching the closed end 130 of the cavity. Generally, the stub 170 may impede the propagation of electromagnetic energy anywhere along the portion of the transmission path within the waveguide assembly before that portion overlaps with the closed end 130 of the cavity.

Generally, the sliding port tap assembly 140 and the waveguide assembly 110 may be moved relative to each other, so that the distance between the communication units may be changed. Such a feature is beneficial because it allows the relative positions of EHF communication units to change while maintaining communication integrity. Furthermore, such a feature also provides a much broader alignment tolerance between the relative positions of transmitting and receiving EHF communication unit pairs compared to mechanical connectors and other point-to-point wireless connectivity techniques. Similarly, in the planar configurations, the sliding port may slide relative to the waveguide assembly to change the length of signal propagation.

Figure 2:
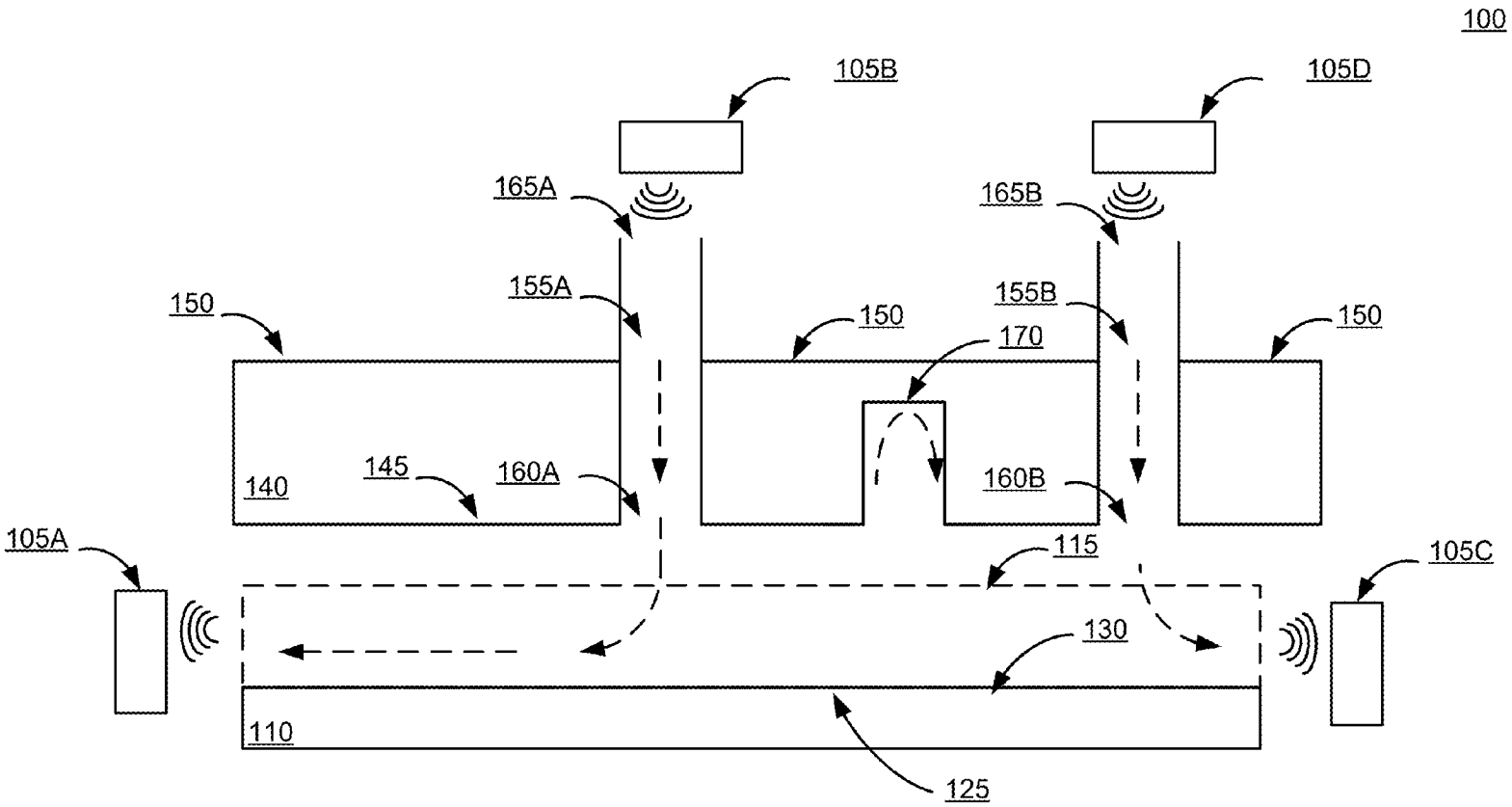
FIG. 2 is a side view of another implementation of a waveguide assembly system for establishing a communication channel between multiple pairs of EHF communication units, according to one embodiment.

Because the stubs 170 function to cancel continued signal propagation or absorb signals, the same waveguide assembly 110 and sliding port tap assembly 140 may support chip communication between multiple sets of EHF communication units 105. For example, as shown in FIG. 2, a stub 170 is placed between two communication EHF units 105B and 105B that share the same sliding port tap assembly 140, but are each paired with different EHF communication units 105A and 105C, respectively. The stub 170 operates to impede EHF energy generated by EHF communication unit 105B from reaching EHF communication unit 105C, and impede EHF energy generated by EHF communication unit 105D from reaching EHF communication unit 105A. Similarly, when the transmitting and receiving EHF communication units 105 are reversed, the stub 170 impedes EHF energy generated by EHF communication unit 105A from reaching EHF communication unit 105D, and impedes EHF energy generated by the EHF communication unit 105C from reaching EHF communication unit 105B.

Figure 3A:
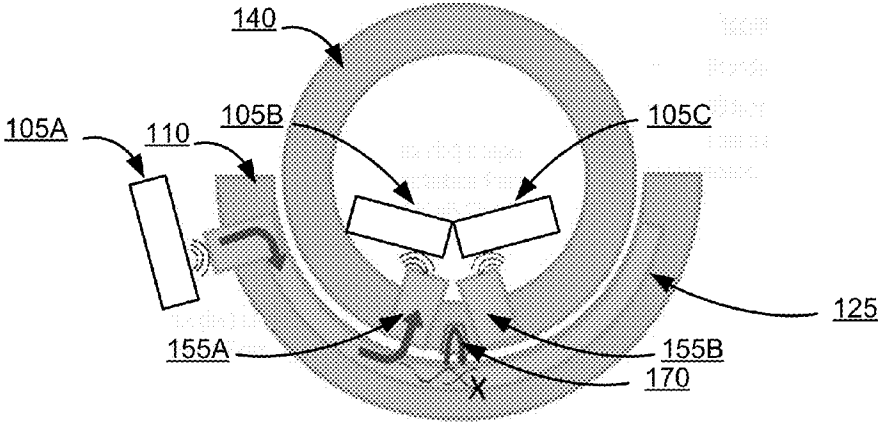
FIG. 3A is a side view of another implementation of a waveguide assembly system for establishing a communication channel between multiple pairs of EHF communication units, according to one embodiment.
Figure 3B:
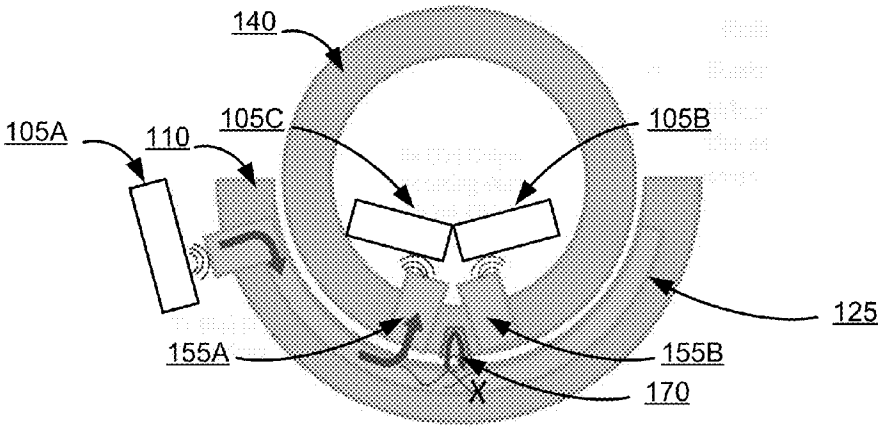
FIG. 3B is a side view of an alternative orientation of the waveguide assembly system of FIG. 3A, according to one embodiment.

The disclosed waveguide system 100 also allows for reversible and bi-directional signal propagation within the same waveguide. For example, by flipping either the sliding port tap assembly 140 or the waveguide assembly 110 with the recess, the EHF communication units 105 in communication may be changed. For example, as shown in FIG. 3A, in one implementation, the waveguide assembly 110 may be configured to communication with a single EHF communication unit 105A and the sliding port tap assembly 140 may be configured to communicate with multiple EHF communication units 105B and 105C using multiple ports 155A and 155B. In an embodiment where there are two EHF communication units 105B and 105C are coupled to the on the sliding port tap assembly 140, a stub 170 may be placed between the two EHF communication units 105B and 105C. As shown in FIG. 3A, the EHF communication unit 105B receives the EHF energy from the EHF communication unit 105A via the waveguide assembly 110 and the port 155A. The stub 170 impedes the EHF energy generated by the EHF communication unit 105A from reaching the EHF communication unit 105C. When the sliding port is reversed, relative to the waveguide, the communication unit paired with the communication unit on the waveguide may change. For example, as shown in FIG. 3B, the EHF communication unit 105C receives EHF energy from EHF communication unit 105A via waveguide assembly 110 and port 155A. The stub 170 impedes the EHF energy generated by the EHF communication unit 105A from reaching the EHF communication unit 105B. Although the reversible assembly is depicted using a circular circuit waveguide assembly 110 and a circular sliding port tap assembly 140, waveguide assemblies 140 and sliding port tap assemblies of other shapes may be used in a similar manner.

In providing distance flexibility between chips, the length of the waveguide assembly 110 and the position of the stub(s) 170 and the EHF communication units 105 may be chosen according to the maximum distance desired between chips. For example, in a cylindrical configuration, such as that shown in FIGS. 3A and 3B, it may be desirable to allow for near 360 degree rotation between the sliding port tap assembly 140 and the waveguide assembly 110. In this embodiment, the waveguide assembly may be configured to substantially surround the sliding tap port assembly 140.

Upon reading this disclosure, those of skill in the art will appreciate still additional alternative designs for a waveguide assembly systems that includes a waveguide assembly and a sliding port tap assembly for communicating data between components or devices using wireless EHF connectivity. For example, disclosed embodiments may include one or more stubs 170 in the waveguide assembly 110 rather than the sliding tap port assembly 140. Alternatively, other embodiments include one or more stubs 170 in both the waveguide assembly 110 and the sliding port tap assembly 140. Additional embodiments include RF absorbing material at a closed end of the waveguide assembly 110 and/or the closed end of the sliding port tap assembly 140. Further embodiments include changing the shape of the absorbing elements in a manner similar to varying the dimensions of the stubs 170 as previously described. For example, when placed at the end of the waveguide assembly 110, a cone shape disposed with its tip towards incoming EHF energy may absorb more EHF energy than a fully filled cube that forms a flat surface facing the incoming EHF energy. When using a cone shaped absorbing element positioned in such a manner, less EHF energy may reflect from the cone back in the direction to where the EHF energy originated, because the incident EHF energy slowly gets absorbed as it goes along the sides of the cone. The reflected waves propagate between the sides of the waveguide assembly 110 and the cone. In contrast, if the EHF energy travels directly into a flat surface of a cube shaped absorbing element, some of the energy may still reflect off the flat surface of the absorbing element material back in the direction to where the EHF energy originated.

Thus, while particular embodiments and applications of the specification have been illustrated and described, it is to be understood that the disclosure is not limited to the precise construction and components disclosed herein and that various modifications, changes and variations which will be apparent to those skilled in the art may be made in the arrangement, operation and details of the method and apparatus of the present disclosure disclosed herein without departing from the spirit and scope of the present disclosure.

What is claimed is:

1. A system comprising:

a fixed port, a sliding port, and a transmission path from the fixed port to the sliding port, the transmission path comprising:

a waveguide assembly comprising a first minor face corresponding to the fixed port, a first major face positioned orthogonal to the first minor face and including a recess extending from the first minor surface towards a second minor face of the waveguide assembly, the second minor face disposed on an end of the waveguide assembly opposite the first minor face; and a port assembly having a first major surface disposed opposite to the first major surface of the waveguide assembly, the port assembly comprising:

at least one port having a first opening on the first major surface of the port assembly and a second opening on a second major surface of the port assembly, the second opening of the port corresponding to the sliding port and disposed on an end of the port assembly opposite the first major face of the port assembly; and a reactive element disposed within port assembly on the first major surface of the port assembly at a specified distance from the first opening.

2. The system of claim 1, wherein at least a portion of the first opening of the port is positioned above the recess to form a communication channel along the transmission path.

3. The system of claim 1, wherein the fixed port is configured to receive extremely high frequency (EHF) electromagnetic energy, and the transmission path is configured to propagate the received EHF energy from the fixed port to the sliding port.

4. The system of claim 1, wherein the sliding port is configured to receive extremely high frequency (EHF) electromagnetic energy, and the transmission path is configured to propagate the received EHF energy from the sliding port to the fixed port.

5. The system of claim 3, wherein the specified distance from the first opening is selected to correspond to a location along the transmission path were the received EHF energy reflected from the reactive element generates a waveform that is out of phase from a waveform corresponding to the received EHF energy.

6. The system of claim 1, wherein the reactive element is a stub.

7. The system of claim 1, wherein the recess is comprised of a dielectric material.

8. The system of claim 7, wherein the dielectric material is a plastic.

9. A system comprising:

a fixed port, a plurality of sliding ports, and a transmission path from the fixed port to each of the plurality of sliding ports, the transmission path comprising:

a waveguide assembly comprising a first minor face corresponding to the fixed port, a first major face positioned orthogonal to the first minor face and including a recess extending from the first minor surface towards a second minor face of the waveguide assembly, the second minor face disposed on an end of the waveguide assembly opposite the first minor face; and a port assembly having a first major surface disposed opposite to the first major surface of the waveguide assembly, the port assembly comprising:

a first port having a first opening on the first major surface of the port assembly and a second opening on a second major surface of the port assembly, the second opening of the first port corresponding to a first sliding port and disposed on an end of the port assembly opposite the first major face of the port assembly; and a reactive element disposed within the port assembly on the first major surface of the port assembly at a specified distance from the first opening of the first port.

10. The system of claim 9, wherein the port assembly further comprises a second port having a first opening on the first major surface of the port assembly and a second opening on the second major surface of the port assembly corresponding to a second sliding port.

11. The system of claim 9, wherein the reactive element is disposed between the first opening of the first port and the first opening of the second port.

12. The system of claim 11, wherein the reactive element is configured to impede extremely high frequency (EHF) electromagnetic energy from propagating from the fixed port to the second sliding port.

13. The system of claim 9, wherein the fixed port is configured to receive extremely high frequency (EHF) electromagnetic energy, and the transmission path is configured to propagate the received EHF energy from the fixed port to the first sliding port.

14. The system of claim 13, wherein the specified distance from the first opening of the first sliding port is selected to correspond to a location along the transmission path were the received EHF electromagnetic energy reflected from the reactive element generates a waveform that is out of phase from a waveform corresponding to the received EHF electromagnetic energy.

15. The system of claim 9, wherein the reactive element is a stub.

16. The system of claim 9, wherein the recess is comprised of a dielectric material.

17. The system of claim 16, wherein the dielectric material is a plastic.

* * * * *